US009022820B2

(12) United States Patent
Pao et al.

(10) Patent No.: US 9,022,820 B2
(45) Date of Patent: May 5, 2015

(54) ASYMMETRICAL CONTACT TERMINAL AND FABRICATION METHOD OF THE SAME

(71) Applicant: Chief Land Electronic Co., Ltd., New Taipei (TW)

(72) Inventors: Chung-Nan Pao, New Taipei (TW); Yu-Hsiung Lin, Pingtung County (TW); Sheng-Hsiang Huang, New Taipei (TW); Chia-Yen Li, New Taipei (TW); Chien-Hsuan Yen, New Taipei (TW)

(73) Assignee: Chief Land Electronic Co., Ltd., New Taipei (TW)

( * ) Notice: Subject to any disclaimer, the term of this patent is extended or adjusted under 35 U.S.C. 154(b) by 219 days.

(21) Appl. No.: 13/726,280

(22) Filed: Dec. 24, 2012

(65) Prior Publication Data

US 2014/0179175 A1 Jun. 26, 2014

(51) Int. Cl.

| | |
|---|---|
| ***H01R 13/02*** | (2006.01) |
| ***H01R 13/24*** | (2006.01) |
| *H01R 43/16* | (2006.01) |

(52) U.S. Cl.

CPC ..... *H01R 13/2492* (2013.01); *H01R 43/16* (2013.01); *Y10T 29/49204* (2015.01)

(58) Field of Classification Search

CPC ..... H01R 13/2492
USPC ..... 439/682, 857, 862
See application file for complete search history.

(56) References Cited

U.S. PATENT DOCUMENTS

| | | | | |
|---|---|---|---|---|
| 5,334,053 | A * | 8/1994 | Noschese | 439/682 |
| 6,039,610 | A * | 3/2000 | Pauza et al. | 439/682 |
| 6,350,134 | B1 * | 2/2002 | Fogg et al. | 439/79 |
| 2002/0098740 | A1 * | 7/2002 | Ooya | 439/630 |
| 2005/0176304 | A1 * | 8/2005 | Yiu | 439/630 |

* cited by examiner

*Primary Examiner* — Khiem Nguyen
(74) *Attorney, Agent, or Firm* — Li & Cai Intellectual Property (USA) Office

(57) ABSTRACT

An asymmetrical contact terminal includes a root portion and at least one first branch and at least one second branch which are spaced apart. The first branch has a first arm portion and a first tip, and the second branch also has a second arm portion and a second tip. The first branch further has a protrusion selectively connects the second arm portion for deforming the force distribution and enhancing the engagement between the contact terminal and an associated housing. The instant disclosure also discloses a fabrication method for making the same.

6 Claims, 10 Drawing Sheets

ASYMMETRICAL CONTACT TERMINAL AND FABRICATION METHOD OF THE SAME

BACKGROUND

1. Field of the Invention

The instant disclosure relates to a contact terminal and a fabrication method of the same; in particular, to an asymmetrical contact terminal having enhanced engagement with a housing.

2. Description of Related Art

Please refer to FIG. 1 in conjunction with FIG. 2A. The conventional plug connector W1 comprises a plurality of single-prong type contact terminals W2, which is prone to deformation by forces and leads to poor connection.

A design shift has gradually changed the structure of the contact terminals. As shown in FIGS. 2A and 2B, the single-prong contact terminal W2 is modified to a dual-prong type contact terminal W3 which resembles a two-end fork. The contact terminal W3 includes a first arm portion W31 and a second arm portion W32 so if one of the arm is distorted, the other can proceed normally.

However, the contact terminals obtain limited benefit from the symmetrical fork design. Typically, when the contact terminal W3 is subject to an external force, the force acts upon the first and second arm portions W31, W32 equally. As shown in FIG. 3, under the same duration of time (x axis, s for second), the tension (y axis, N for Newton) applied to the first and second arm portions W31, W32 is substantially equivalent. Thus, with the symmetrical prong arrangement, each of the arm portions W31/W32 would exhibit substantially identical degree of deformation. The fact that both arm portions W31/32 undergoes the same degree of deformation when being subject to an external force is still undesirable in terms of improving connection reliability of the contact terminal W3.

To address the above issues, the inventor strives via associated experience and research to present the instant disclosure, which can effectively improve the limitation described above.

SUMMARY OF THE INVENTION

The object of the instant disclosure is to provide an asymmetrical contact terminal and the fabrication method thereof for an enhanced engagement between the contact terminals and an associated housing.

The asymmetrical contact terminal comprises a root portion and a first branch and a second branch extending therefrom. The first branch includes a first arm portion and a first tip. Similarly, the second branch includes a second arm portion and a second tip. The first and the second branches are parallel and spaced accordingly. The first branch further includes a protrusion pointing sideway.

The fabrication method of the asymmetrical contact terminal comprises, firstly, providing the contact terminal having the root portion. Secondly, forming at least one first branch and at least one second branch which are spaced apart. The first branch includes a first arm portion and a first tip and the second branch includes a second arm portion and a second tip. Finally, forming a protrusion from the first arm portion.

Preferably, the protrusion is orientated toward the second arm portion and connects the root portion.

Preferably, the protrusion is orientated away from the second arm portion and connects the root portion.

Preferably, the protrusion is orientated toward the second arm portion obliquely and connects thereto.

Preferably, the protrusion connects the root portion.

In summary, the protrusion slightly deforms as the force applied to the first and second branches so the uneven tension distribution prevents simultaneous deformation and the contact terminal effectively remains connected.

In order to further understand the instant disclosure, the following embodiments are provided along with illustrations to facilitate the appreciation of the instant disclosure; however, the appended drawings are merely provided for reference and illustration, without any intention to be used for limiting the scope of the instant disclosure.

DETAILED DESCRIPTION OF THE PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

[First Embodiment]

Figure 1:
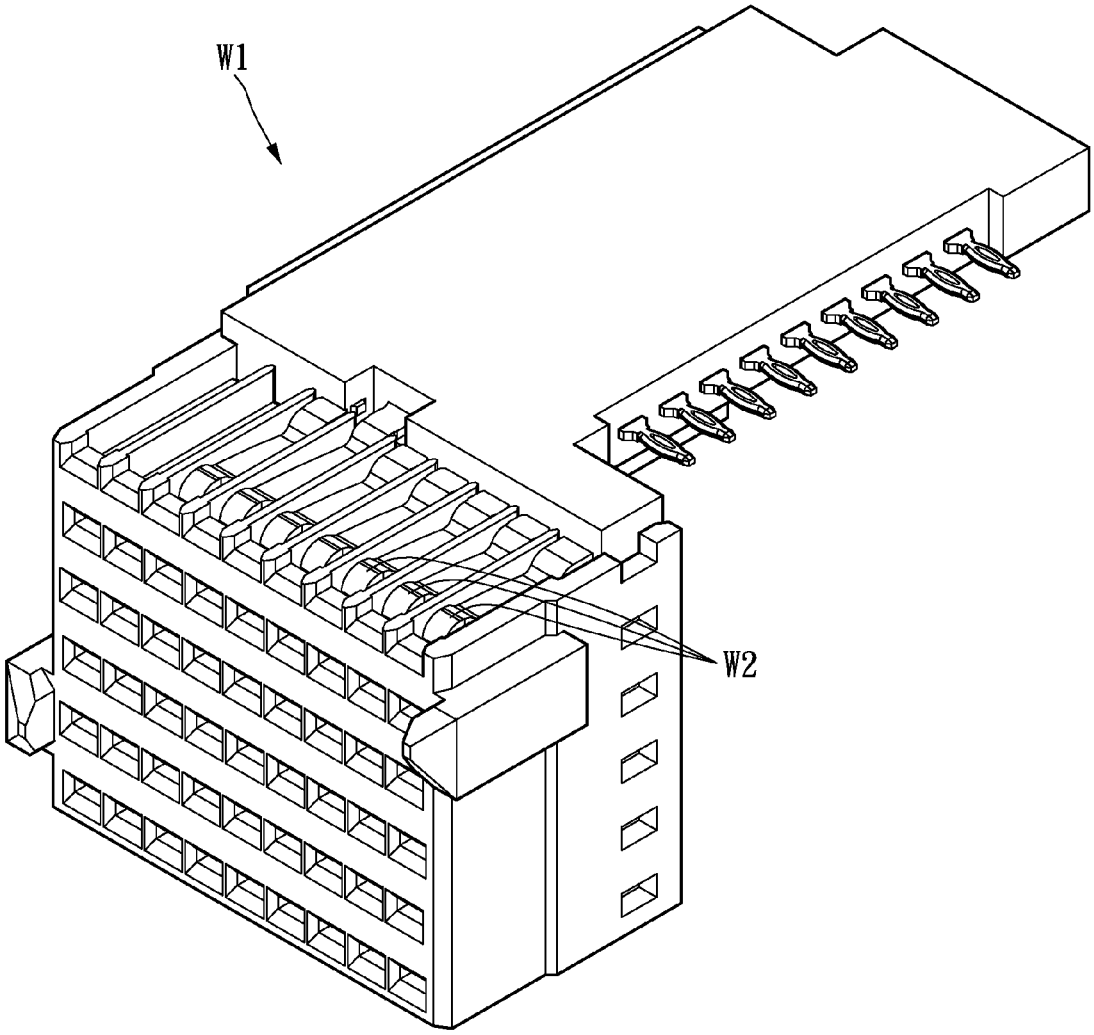
FIG. 1 PRIOR ART
FIG. 1 illustrates a schematic view of a conventional plug connector.
Figure 2A:
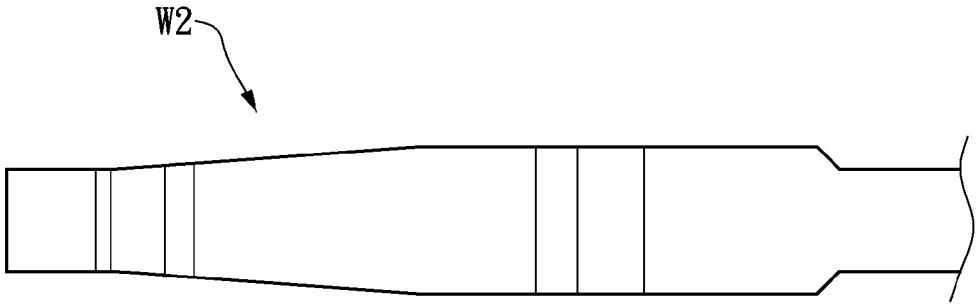
FIG. 2A PRIOR ART
FIG. 2A illustrates a schematic view of a conventional single-end contact terminal.
Figure 2B:
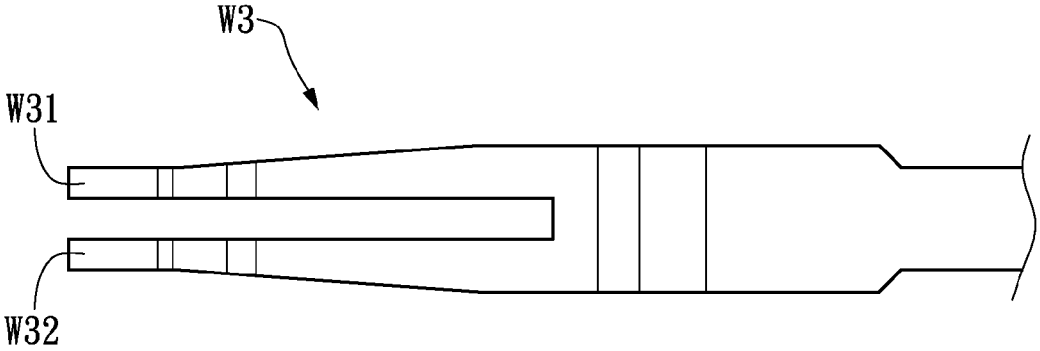
FIG. 2B PRIOR ART
FIG. 2B illustrates a schematic view of a conventional two-end contact terminal.
Figure 3:
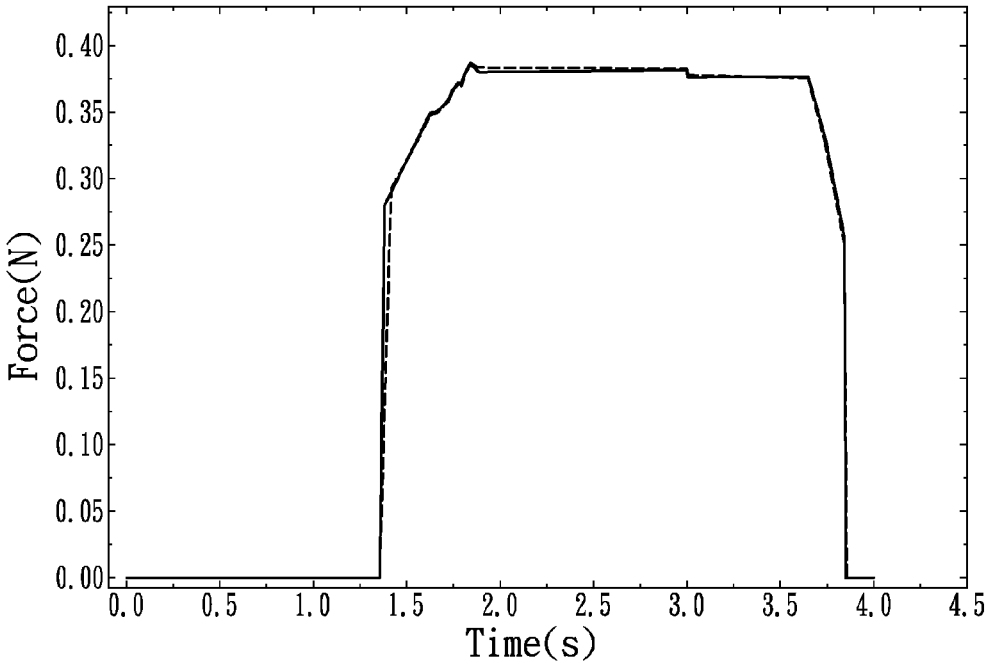
FIG. 3 PRIOR ART
FIG. 3 shows a force-time diagram of a conventional two-end contact terminal.
Figure 4:
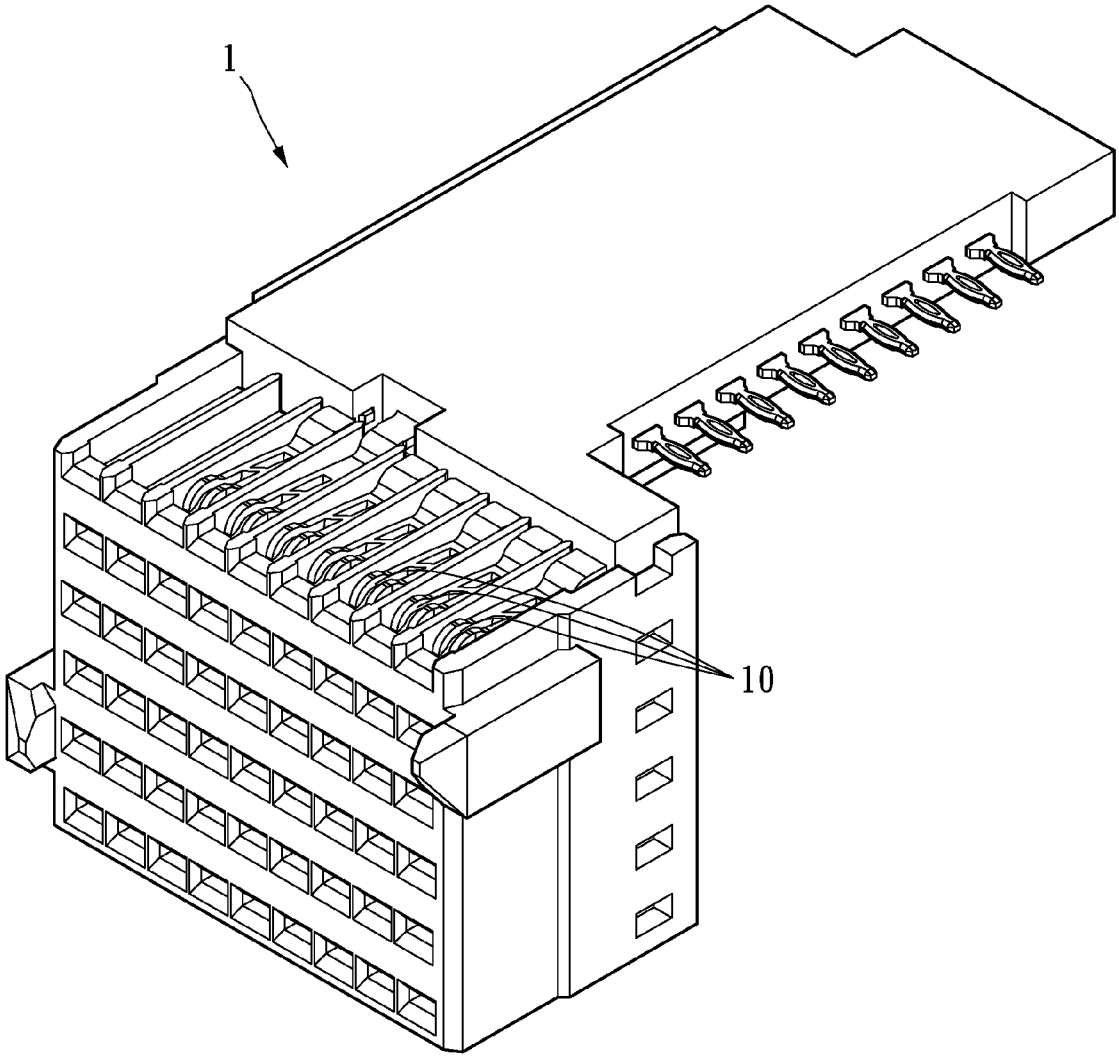
FIG. 4 illustrates a schematic view of a plug connector in accordance with an embodiment of the instant disclosure.
Figure 5A:
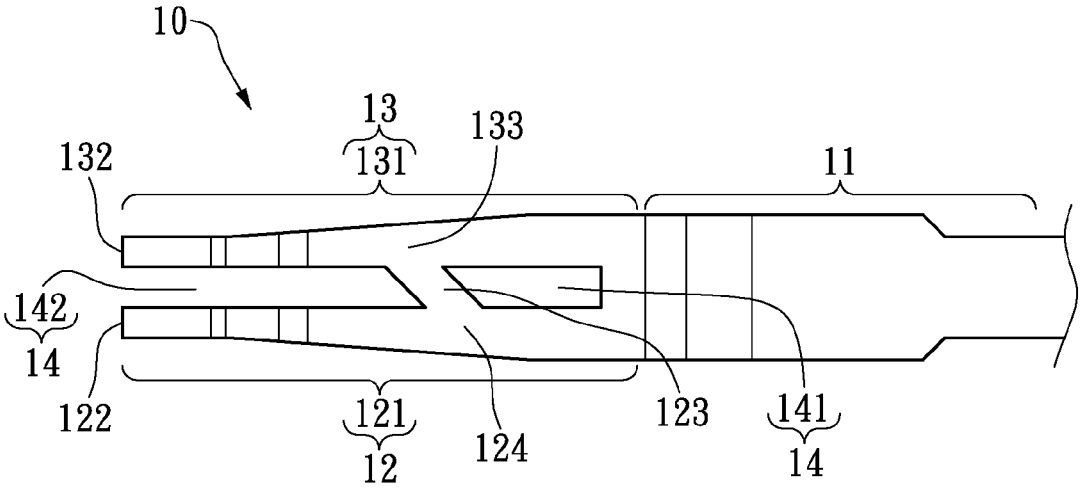
FIG. 5A illustrates a schematic view of a contact terminal in accordance with a first embodiment of the instant disclosure.
Figure 6:
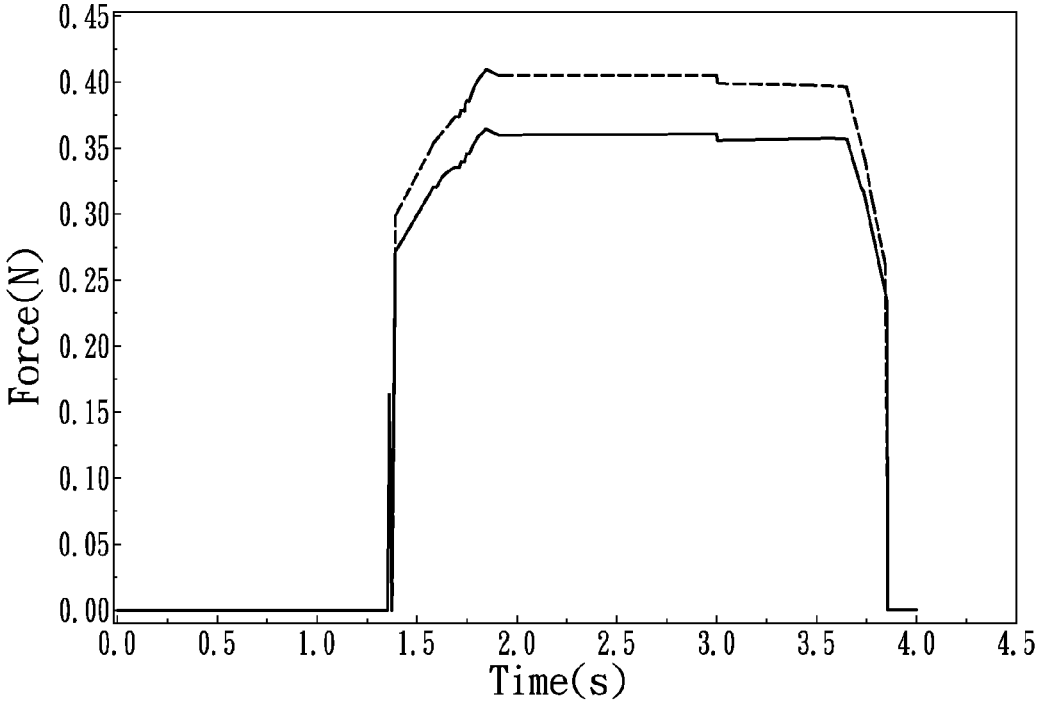
FIG. 6 shows a force-time diagram of a first embodiment illustrated in FIG. 5A.

Please refer to FIGS. 4, 5A and 6. The instant disclosure provides an asymmetrical contact terminal 10 for a plug connector 1. The structure of the contact terminal 10 is able to adapt to different types of plug connectors.

The contact terminal 10 includes a root portion 11 and a first branch 12 and a second branch 13 extending from the root portion 11.

The first branch 12 has a first arm portion 121 and a first tip 122. The second branch 13 has a second arm portion 131 and a second tip 132. Preferably, the first and second branches 12, 13 are parallelly spaced apart, while a protrusion 123 extends from the first arm portion 121 of the first branch 12.

Preferably, the protrusion 123 slantingly extends from the first arm portion 121. The joint of the protrusion 123 and the first arm portion 121 forms a first intersection 124, whereas the joint of the protrusion 123 and the second arm portion 131 forms a second intersection 133. The protrusion 123 slantingly bridges the first and second arm portions 121, 131. Furthermore, because the protrusion 123 extends from the first arm portion 121 obliquely toward the second arm portion 131, the distance between the first tip 122 to the first intersection 124 is different from that of the second tip 132 to the second intersection 133. That is to say the protrusion 123 breaks the symmetrical structure of the first and second branches 12, 13. Please refer to FIG. 5A in conjunction with FIG. 6, and the diagram of FIG. 6 shows the different distribution of force (y-axis, N for Newton) against time (x-axis, s for second). The asymmetrical structure of the contact terminal 10 helps to distribute the force differently toward the first and second branches 12, 13 so to reduce simultaneous deformation.

Figure 5B:
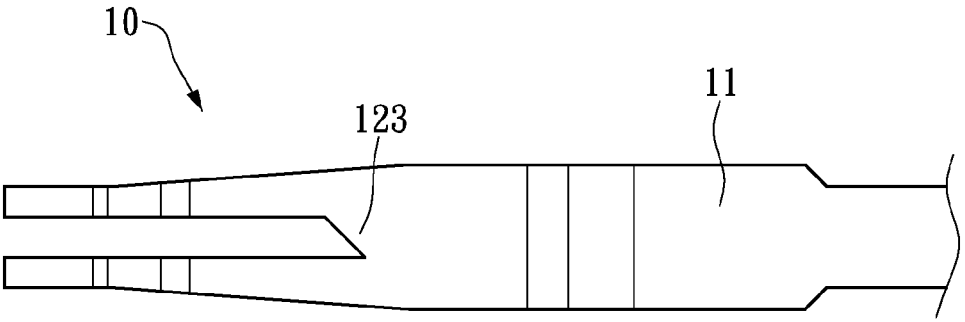
FIG. 5B illustrates a schematic view of another contact terminal in accordance with a first embodiment of the instant disclosure.

Alternatively, please refer to FIG. 5B showing a deviation of the first embodiment in FIG. 5A. The protrusion 123 may further expands toward the root portion 11 and covers the gap between the first and second branches 12, 13 resulting in different force distribution there-between.

[Second Embodiment]

Figure 7:
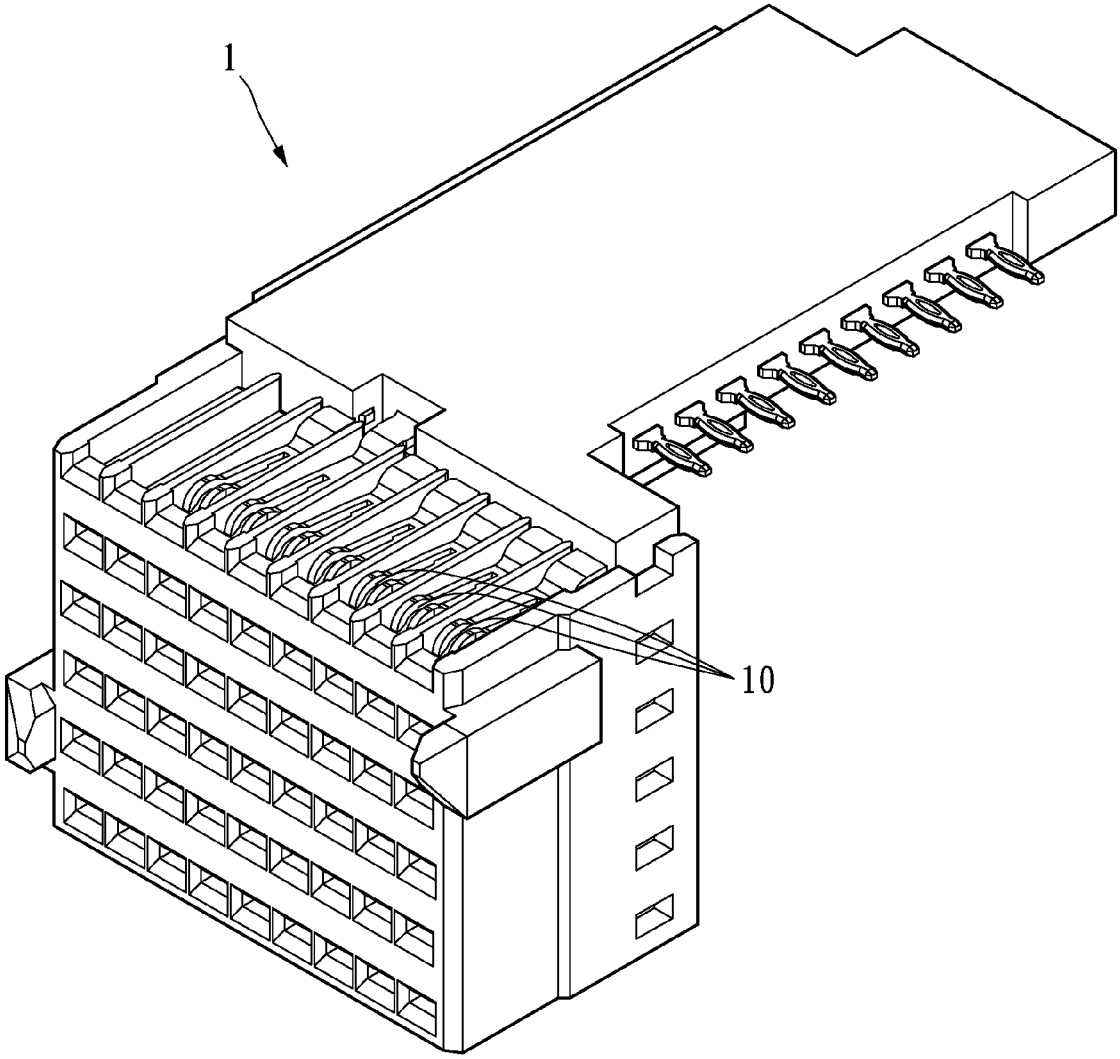
FIG. 7 illustrates a schematic view of a plug connector in accordance with a second embodiment of the instant disclosure.
Figure 8A:
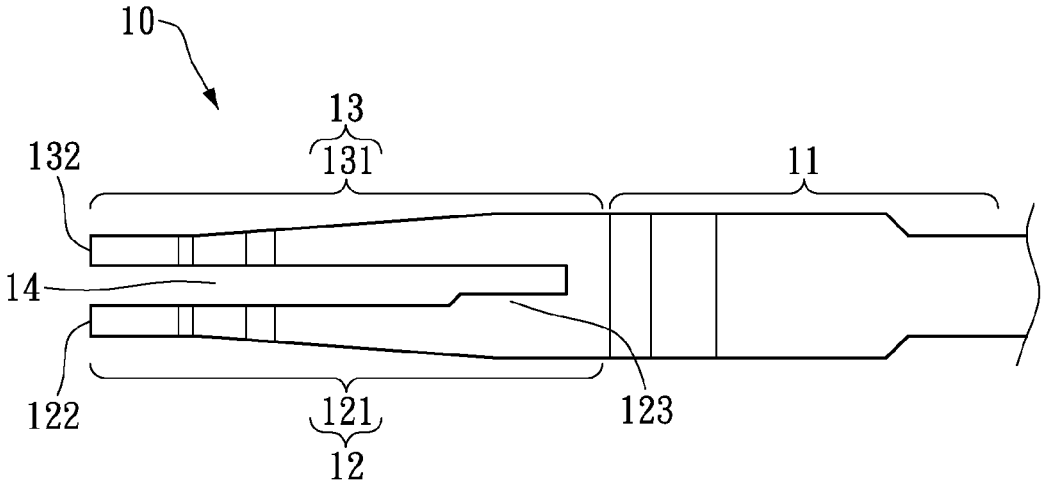
FIG. 8A illustrates a schematic view of a contact terminal in accordance with a second embodiment of the instant disclosure.
Figure 9:
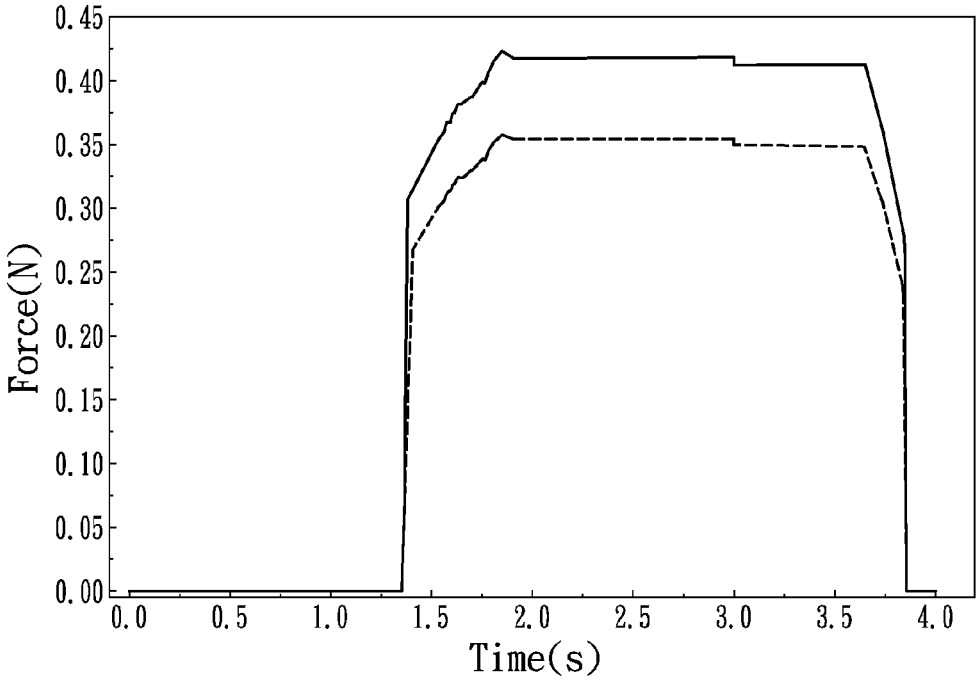
FIG. 9 shows a force-time diagram of a second embodiment illustrated in FIG. 8A.

Please refer to FIG. 7 in conjunction with FIG. 8A. In the instant embodiment, the protrusion 123 stretches from the first arm portion 121 yet not connecting the second arm portion 131. Although not contacting the first arm portion 121, the protrusion 123 still joints with the root portion 11. Please refer to FIG. 9, where the diagram shows the different distribution of force (y-axis, N for Newton) against time (x-axis, s for second). Because of the lack of symmetry in the structure, the contact terminal 10 deforms.

Figure 8B:
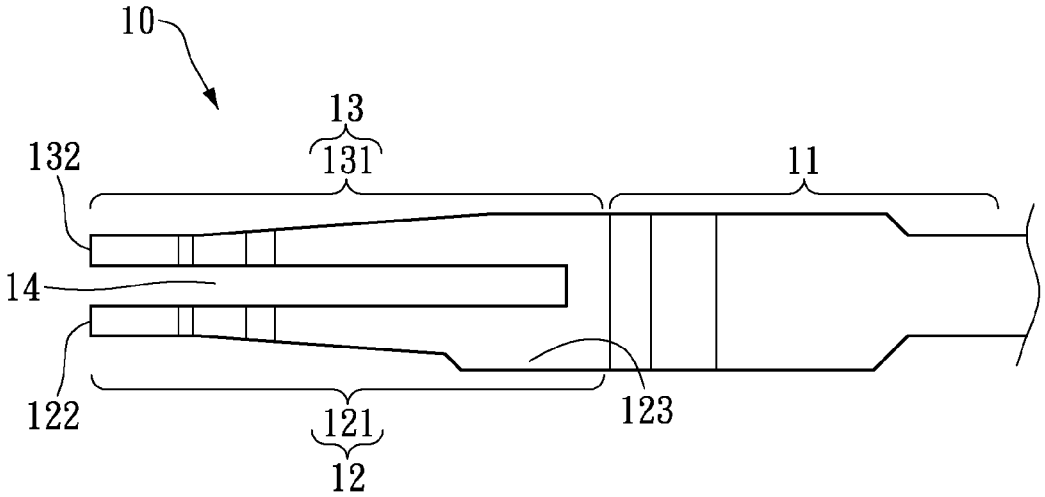
FIG. 8B illustrates a schematic view of another contact terminal in accordance with a first embodiment of the instant disclosure.

Please refer to FIG. 8B showing a deviation of the second embodiment in FIG. 8A. The protrusion 123 stretches outwardly, away from the second arm portion 131 and still connects the root portion 11. In other words, the orientation of the protrusion 123 has a great variety.

The number of branches is not limited to two so three branches or above is also acceptable. In addition, the protrusion can be applied to any one of the branches.

Figure 10:
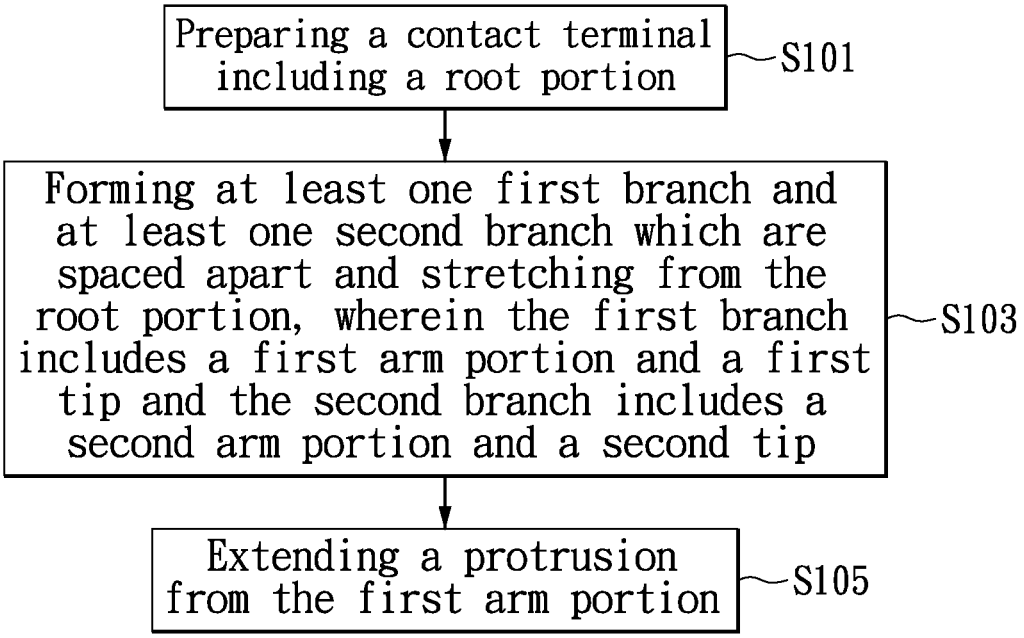
FIG. 10 shows a flow chart of a fabrication method for a contact terminal in accordance with the instant disclosure.

Please refer to FIG. 10. The instant disclosure further provides a fabrication method for the asymmetrical contact terminal, which comprises steps of:

S101: Providing the contact terminal 10 having the root portion 11.

S103: Forming at least one first branch 12 and at least one second branch 13 which are spaced apart. The first branch 12 includes a first arm portion 121 and a first tip 122 and the second branch 13 includes a second arm portion 131 and a second tip 132.

S105: Forming a protrusion 123 from the first arm portion 121. The protrusion 123 may be orientated toward the second arm portion 131 and contacts the root portion 11. In contrast, the protrusion 123 can point away from the second arm portion 131 and still connects the root portion 11. Alternatively, the protrusion 123 may be orientated toward the second arm portion 131 obliquely and connects both the second arm portion 131 as well as the root portion 11.

In summary, the instant disclosure provides the asymmetrical contact terminal and the fabrication method thereof to enhance the engagement between the contact terminals and an associated housing. Additionally, the asymmetrical structure results in different force distribution so to prevent from simultaneous deformation.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. An asymmetrical contact terminal comprising:

a root portion, and extending therefrom at least:

a first branch having a first arm portion and a first tip; and a second branch having a second arm portion and a second tip;

wherein the first and second branches extend abreast and are spaced apart from each other, wherein the first arm portion haves a protrusion that slantingly extends from the first arm portion toward the second arm portion and connects to the second arm portion, wherein an aperture is formed and defined by the protrusion, the first branch, the second branch and the root portion.

2. The asymmetrical contact terminal according to claim 1, wherein the protrusion extends toward the second arm portion yet joints with the root portion solely.

3. The asymmetrical contact terminal according to claim 1, wherein the protrusion points away from the second arm portion and joints with the root portion.

4. A fabrication method for an asymmetrical contact terminal, comprising:

providing a contact terminal including a root portion;

forming at least one first branch and at least one second branch which are spaced apart and stretching from the root portion, wherein the first branch includes a first arm portion and a first tip and the second branch includes a second arm portion and a second tip; and forming a protrusion that slantingly extends from the first arm portion toward the second arm portion and connects to the second arm portion to form an aperture defined by the protrusion, the first branch, the second branch and the root portion.

5. The fabrication method for the contact terminal according to claim 4, wherein the protrusion extends slantingly toward the second arm portion and connects thereto.

6. The fabrication method for the contact terminal according to claim 4, wherein the protrusion joints with the root portion.

* * * * *